US005681248A

United States Patent [19]

Vani

[11] Patent Number: 5,681,248

[45] Date of Patent: Oct. 28, 1997

[54] MULTI-PURPOSE EXERCISE DEVICE

[76] Inventor: Robert J. Vani, 215 Sunset Dr., Libertyville, Ill. 60048

[21] Appl. No.: 690,588

[22] Filed: Jul. 26, 1996

[51] Int. Cl.[6] ..... A63B 21/02

[52] U.S. Cl. ..... 482/126; 482/10; 482/124

[58] Field of Search ..... 482/10, 74, 124, 482/126, 140

[56] References Cited

U.S. PATENT DOCUMENTS

| | | | |
|---|---|---|---|
| 4,335,875 | 6/1982 | Elkin | 482/74 |
| 4,441,707 | 4/1984 | Bosch | 482/74 |
| 4,733,862 | 3/1988 | Miller . | |
| 4,762,318 | 8/1988 | Phillips et al. . | |
| 4,852,874 | 8/1989 | Sleichter, III et al. . | |
| 4,961,573 | 10/1990 | Wehrell | 482/124 |
| 5,169,372 | 12/1992 | Tecco . | |
| 5,267,931 | 12/1993 | Faetini . | |
| 5,295,949 | 3/1994 | Hathaway . | |
| 5,342,274 | 8/1994 | Hunker . | |
| 5,352,174 | 10/1994 | Mason et al. . | |
| 5,492,520 | 2/1996 | Brown . | |
| 5,514,059 | 5/1996 | Romney | 482/124 |

*Primary Examiner*—Lynne A. Reichard
*Attorney, Agent, or Firm*—Barry L. Clark

[57] ABSTRACT

Portable multi-purpose exercise device has an elongated generally tubular, and preferably cylindrical, cushion or pillow portion which is adapted to be placed behind a user's head and neck or other body portion while handle members attached to the outer ends of a stretchable cord-like tension member extending from each end of the pillow portion are engaged and pulled by the user's hands. The pillow portion preferably comprises one or more layers of resilient foam surrounding rigid sleeve members through which the tension member passes. The device is very lightweight and compact, and yet permits many exercise routines to be performed to strengthen a wide range of muscle groups. The device is especially helpful in providing head and neck support while doing ab crunches, for example.

10 Claims, 1 Drawing Sheet

MULTI-PURPOSE EXERCISE DEVICE

BACKGROUND

Comprehensive conditioning of the human body has traditionally required numerous exercise machines. Such machines run the gamut from multi-station mini-gyms down to uniquely configured units dedicated to one muscle group. The machines are typically large, heavy, and expensive, and for such reason are usually located only in health clubs or gymnasiums or the like. Thus, users of the machines must make the added effort of travel to such location, and even then perhaps wait for availability of certain machines.

Despite the number and sophistication of modem day exercise machines, the human abdomen remains one of the most difficult body parts to keep conditioned. Weak stomach muscles can cause a myriad of maladies, particularly including back problems. For decades the traditional "sit-up" was deemed the best way to tame the stomach. But experience has shown that sit-ups can prove counterproductive, not only by contributing to neck and back problems, but in enlarging particular stomach muscles rather than flattening them. More recently, the "crunch" has come more in vogue as a fairly effective but less traumatic therapy for the human midsection. Examples of non-resilient head and neck supporting devices for assisting a "crunch" type exercise are shown, for example, in U.S. Pat. No. 5,169,372 to Tecco; U.S. Pat. No. 5,267,931 to Faetini and in U.S. Pat. No. 5,295,949 to Hathaway, all of which appear to be dedicated to one particular exercise and muscle group. In addition, U.S. Pat. No. 5,492,520 to Brown shows a rather large and heavy and quite bulky device having a frame formed of a formed metal tubing which has arm supports and a headrest for allowing the strengthening of abdominal muscles while the user's upper torso causes the device to rock on the floor.

The literature describes and the market provides various types of exercise devices which incorporate stretchable lengths of resilient tubing which are used for differing muscle groups. See, for example, U.S. Pat. No. 5,352,174 to Mason et al.; U.S. Pat. No. 4,733,862 to Miller; U.S. Pat. No. 5,342,274 to Hunker; U.S. Pat. No. 4,762,318 to Phillips et al and U.S. Pat. No. 4,852,874 to Sleichter III et al.. The devices of these patents are not particularly suited for conditioning the abdominal muscles.

What is desired, therefore, is a convenient, portable, and affordable exercise device which facilitates conditioning of numerous portions of the human anatomy, including the abdominal muscles.

SUMMARY

Portable exercise device for performing numerous exercises to strengthen the muscles in the abdomen, legs, thighs, arms and other portions of the body has a generally tubular, and preferably cylindrical, elongated padded pillow or cushion portion which is bendable so as to be able to conform to and uniformly cushion the user's neck and head or other body portions. Although a cylindrical shape is preferred, other generally tubular shapes, such as square or triangular, for example, would also be suitable. A pair of stretchable cord-like members extend from the ends of the padded pillow portion and each has a handle at its outer end which allows the stretchable members to be elongated. The resilient nature of the cord-like members allows the user to pull on the opposed handles when the pillow portion is positioned under the user's neck and head in order to gently support the user's neck and head while the abdominal muscles are being used to lift the torso during an ab crunch, for example. Likewise, an oblique crunch can be performed by crossing one leg and moving one forearm toward the opposite knee. Triceps overheads are performed with the user's back and head on the floor and the hands engaged with the handles while the forearms are moved upwardly. Still another exercise that can be done with the pillow portion positioned behind the neck and head is a "pushup with resistance" in which the hands engage the handles against the floor as the torso is lifted against the resistance of the stretchable members. This exercise is the equivalent of lifting barbells while laying on one's back. A biceps curl is done in a sitting position with the knees bent and the pillow under the feet while the handles are held so that the palms face the torso as the cord members are pulled. A seated row is similar except the palms are down and the wrist is mined as the handles are pulled toward the torso. Floor work can also be done such as an exercise for the inner thighs where the handles are held under one foot while the pillow is wrapped around the opposite leg and the opposite leg is moved in a direction to tension the cord members. Preferably, the handles are attached to a single length of resilient natural rubber latex tubing such as that sold by Spri Products Inc. of Buffalo Grove, Ill. Tubing having a minimum tensile PSI of 3500, and preferably 4000, and a break elongation of at least 750% has been found to be quite suitable for a wide range of users. For those persons for whom the tension seems a little too light, additional repetitions can provide the same strengthening as if a tubing with a higher tension were present. The tubing preferably passes through at least two short lengths of rigid plastic sleeve members positioned inside the pillow member. The plastic sleeve members are spaced from each other to allow the pillow to bend around and conform to a body part. They also guide and isolate the tubing and protect the interior foam structure of the pillow from being damaged as the tubing is stretched and becomes very thin. Preferably, the cushioned interior of the pillow member, which may, for example, be formed of a single molded piece of resilient foam such as polyurethane or a rolled up sheet of resilient foam, or even from batting or another suitable material, is covered with a cover member which is preferably made of a durable fabric. Since the pillow member is likely to absorb sweat from the user, the entire assembly is preferably made so as to be washable.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
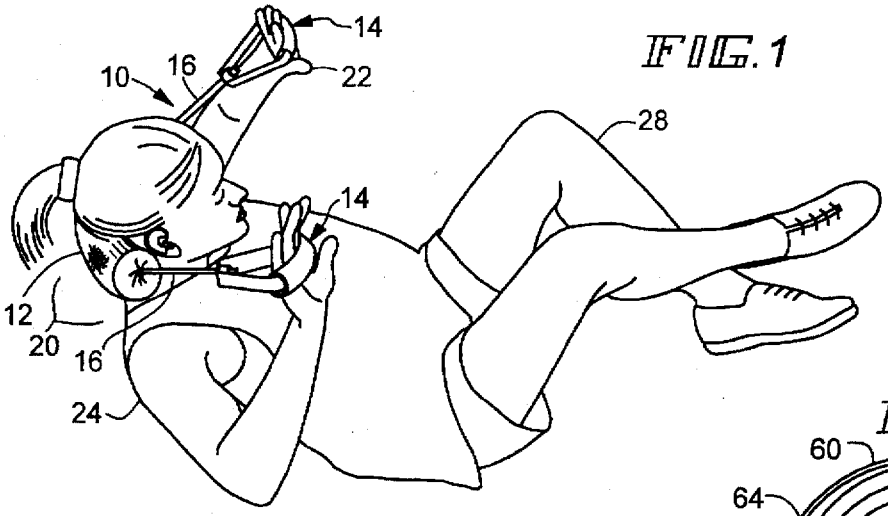
FIG. 1 is a perspective view showing an exercise device according to the invention being used to support the weight of a person's head during an ab crunch.

FIG. 1 illustrates an exercise device 10 in accordance with the invention being used to support the weight of a user's head during an ab crunch exercise. The device 10 includes a pillow or cushion portion indicated generally at 12 and a pair of handle means in the form of handle assemblies indicated generally at 14. A length of stretchable tubing 16 passes through the center of the pillow portion 12 so as to be isolated from the outer surface of the pillow portion by cushioning material and is attached at its ends to the handle assemblies 14. For the particular exercise shown, the pillow 12 is preferably placed at a location 20 which is behind the lower rear portion of the user's head and the upper portion of the user's neck. The handle assemblies are then engaged and pressed forwardly and upwardly by the user's hands 22. As the user lifts up the shoulders 24 the abdominal muscles are worked. Preferably, the exercise is done with the legs 28 raised.

Figure 2:
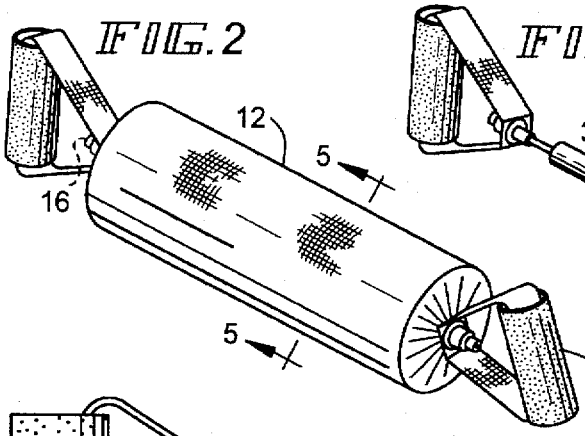
FIG. 2 is a perspective view of an exercise device according to the invention in its normal rest position.

FIG. 2 shows the device 10 in its "at rest" position in which the tubing 16 is under a very slight tension sufficient to hold the handle assemblies 14 in abutting contact with the ends of the pillow portion 12.

Figure 3:
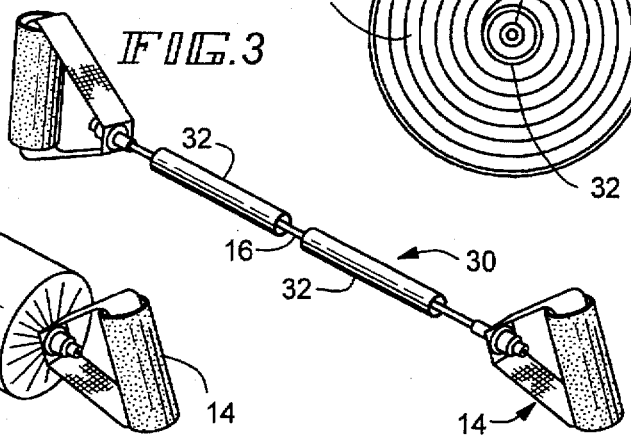
FIG. 3 is a perspective view showing the handles, the guide sleeves and the tubing assembly of the exercise device of FIG. 2 with the covered pillow or cushion portion removed.

FIG. 3 shows a tubing and handles assembly 30 which comprises the handle assemblies 14, the tubing 16, and a pair of tubular guide sleeve members 32. The guide sleeve members 32 are preferably made from short sections of rigid PVC tubing and are adapted to be positioned on the center axis of the tubular pillow portion 12. Since the tubing 16 is only about ¼ inch in diameter, and much less when it is stretched, the sleeve members guide and support it and provide a much larger surface to spread its loading to the interior portions of the pillow 12 when the handle assemblies 14 are being pulled at an angle to the axis of the pillow, such as is shown in FIG. 1. The sleeve members 32 are preferably located near the ends of the pillow 12 and have a combined length less than the length of the pillow in order to permit the pillow to be bent around a user's head and neck or other body parts.

Figure 4:
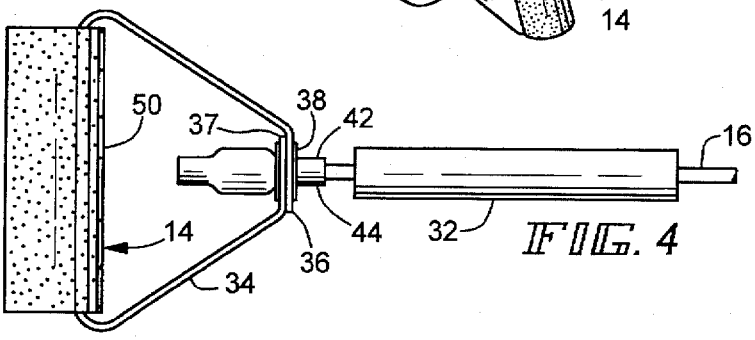
FIG. 4 is a fragmentary enlarged top view showing the relationship of the handles, guide sleeves, tubing and the tubing retaining means of FIG. 3.

FIG. 4 shows an enlarged view of one of the handle assemblies 14 and its relationship to the tubing 16 and sleeves 32. A length of nylon webbing 34 having a preferred width of about 1 inch has its ends 36, 37 overlapped and firmly joined together by a grommet member 38. The grommet member 38 has an enlarged axial opening 39 (best seen in FIG. 7) to accommodate a short length of rubber tubing 42 which is telescoped over the ends of the tubing 16. The inner end portion 44 of the short length of tubing 42 contacts the side walls of the grommet opening 39 and extends a short distance inwardly toward the pillow 12 to protect and reinforce the tubing 16. The outer end portion of the short length of tubing 42 has a greatly enlarged diameter portion which forms a shoulder portion 46 which serves to contact the outer surface 48 of the grommet 38 and to uniformly transfer all of the forces applied to the handle assemblies 14 to the tubing 16. To increase the comfort of the handle assembly, a short length of hollow soft foam tubing 50 is placed over the webbing 34 before the webbing end portions 36, 37 are joined together.

Figure 5:
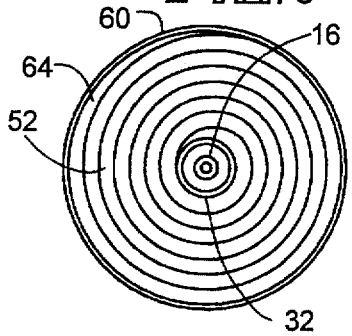
FIG. 5 is a cross-sectional view of the exercise device taken on line 5—5 of FIG. 1 illustrating a cushion formed of a sheet of helically wrapped foam.

FIG. 5 is a cross-sectional view taken on line 5—5 of FIG. 2 and illustrates one embodiment of a pillow construction in which a sheet of cushioning material, such as foam 52, is helically wrapped around the tubing 16 and sleeve members 32 to form a firm, but resilient, pillow or cushion portion 64. A sheet of polyurethane having a thickness of ½ inch has been found to be quite suitable. A cloth cover 60 is preferably provided for the outside of the pillow portion 64. The cover 60 is preferably made of a durable fabric which will maintain a tight contact with the inner cushioning material 52. The cover 60 is preferably made long enough so that it will overlie the ends of the pillow 64 and, with the assistance of a retaining means, such as tie strings or end rings of elastic, cause the fabric to engage and cover the ends of the pillow. Alternatively, the cover could be made of other materials and sewn or held in place with fastening means such as strips of Velcro® hook and loop fasteners.

Figure 6:
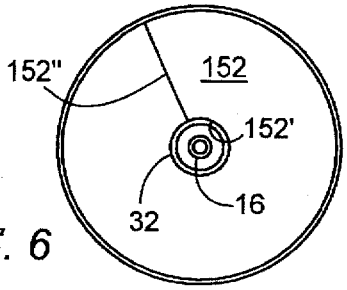
FIG. 6 is a cross-sectional view similar to FIG. 5 but illustrating an embodiment in which the foam cushion is solid.

FIG. 6 is a cross-sectional view similar to FIG. 5 but illustrating an alternative embodiment in which the foam is not helically wound as in FIG. 5 but is molded in one piece 152 with a passage 152' down the center to accommodate the sleeve members 32 and the tubing 16. To facilitate assembly of the tubing and handles assembly 30 into the hollow passageway 152', the foam may be split along a radial line 152". Depending upon the type of foam used, one might even dispense with the need for a cover. However, a cover does add additional comfort and durability. The cushion could also be molded around the handle and tubing assembly and the cover could be integrally formed of self skinning polyurethane.

Figure 7:
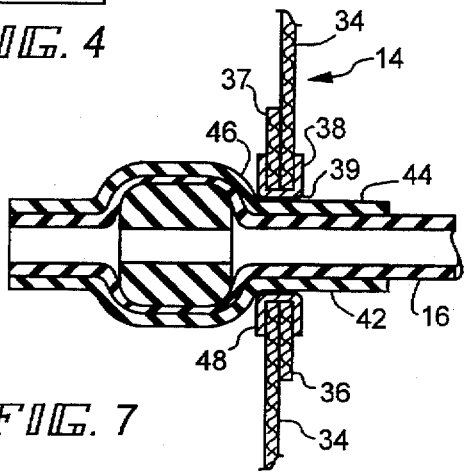
FIG. 7 is a cross-sectional view showing the relationship in which the handle assembly of FIG. 4 transfers loading applied to the handle assembly to the stretchable tubing.

FIG. 7 is a fragmentary cross-sectional view taken in a horizontal plane through the axis of the handle assembly 14 and tubing 16 in FIG. 4. The view illustrates the means by which a pulling force applied to the handle assembly 14 from the left through the webbing loop 34 is transferred to the stretchable tubing 16. The construction illustrated is similar to that shown in U.S. Pat. No. 4,852,874 to Sleichter, III et al wherein two tubing ends are spliced into an endless loop. An enlarged rubber plug 68 is installed into the left end of tubing 16 after the short length of larger diameter tubing 42 has been telescopically placed over the end of tubing 16 and the tubing 16 has been moved to the left through the opening 39 in the grommet 38. The tremendous expansion of the rubber tubes 16 and 42 which must take place to permit the insertion of plug 68 produces the retaining shoulder portion 46 and ensures that forces applied to the shoulder 46 by the surface 48 of the grommet 38 when the handle assembly 14 is actuated will be incapable of allowing the plug 68 to be pulled out.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

1. A compact portable exercise device especially suited for gently supporting a user's head and neck while the user is performing abdominal crunches, comprising an elongated, generally cylindrical cushion member having an axially extending opening and a resilient length of tubing positioned for unrestrained movement within said axially extending opening, the ends of said resilient tubing each having an enlarged diameter portion which engages and retains a generally D-shaped handle assembly comprising a length of flexible webbing which passes through the center of a tubular gripping portion having a cushioned outer gripping surface, said length of webbing being in the form of a loop with an aperture therein and said resilient tubing passing through said aperture, said resilient tubing having an overall length such that said generally D-shaped handle assemblies are normally in contact with the ends of said cushion member.

2. The exercise device of claim 1 wherein said resilient tubing has an overall length such that said generally D-shaped handle assemblies are resiliently biased into contact with the ends of said cushioned member.

3. The exercise device of claim 1 wherein said enlarged diameter portions at the ends of said resilient tubing engage a grommet member which surrounds the aperture in said loop of webbing.

4. An exercise device as recited in claim 1 wherein said generally elongated cushion member comprises a resilient portion which is bendable along its length and is surrounded by a cover portion.

5. An exercise device as recited in claim 1, wherein said generally elongated cushion member has an internal portion comprising one or more layers of resilient foam padding.

6. An exercise device as recited in claim 1, wherein said generally elongated cushion member has an internal portion comprising a solid resilient foam body portion having an elongated hollow interior portion.

7. An exercise device as recited in claim 1, wherein at least two axially extending and axially spaced apart sleeve members are positioned inside the elongated cushion member for permitting the cushion member to be bent around a body part and for guiding the movement of the single length of resilient tubing and preventing it from contacting and causing harm to the cushioning material when the handle means are being moved relative to each other and the cushion member in either an axial or non-axial direction so as to stretch the resilient tubing.

8. An exercise device as recited in claim 1, wherein the resilient tubing has a minimum tensile PSI of 3500.

9. An exercise device as recited in claim 8, wherein the resilient tubing has a minimum 750% elongation at break.

10. An exercise device as recited in claim 1, wherein said generally elongated cushion member has a length in a range of about 10–14 inches and a diameter in a range of about 3–5 inches.

* * * * *